US012679625B2

(12) United States Patent
Sato et al.

(10) Patent No.: US 12,679,625 B2
(45) Date of Patent: Jul. 14, 2026

(54) CUSHIONING MEMBER FOR PACKED OBJECT

(71) Applicant: SUZUKI MOTOR CORPORATION, Hamamatsu (JP)

(72) Inventors: Atsushi Sato, Hamamatsu (JP); Wataru Karasudani, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 19/018,973

(22) Filed: Jan. 13, 2025

(65) Prior Publication Data

US 2025/0296757 A1 Sep. 25, 2025

(30) Foreign Application Priority Data

Mar. 22, 2024 (JP) ..... 2024-046778

(51) Int. Cl.
*B65D 81/113* (2006.01)
*B65D 85/68* (2006.01)

(52) U.S. Cl.
CPC ..... *B65D 81/113* (2013.01); *B65D 85/68* (2013.01); *B65D 2581/053* (2013.01); *B65D 2581/055* (2013.01); *B65D 2585/6877* (2013.01)

(58) Field of Classification Search
CPC ..... B65D 81/113; B65D 85/68; B65D 2581/053; B65D 2581/055; B65D 2585/6877; B65D 81/054; B65D 81/107
USPC ..... 206/453, 454, 523, 319
See application file for complete search history.

(56) References Cited

U.S. PATENT DOCUMENTS 5,339,958 A * 8/1994 Taravella ..... B65D 81/05 206/521
8,251,220 B2 * 8/2012 Ting ..... B65D 25/103 206/521
8,720,691 B2 * 5/2014 Hu ..... B65D 5/5088 206/454
8,777,008 B2 * 7/2014 Hu ..... B65D 81/051 206/454
8,820,527 B2 * 9/2014 Chan ..... B65D 81/055 206/453
2014/0097115 A1 * 4/2014 Kuo ..... B65D 81/052 206/522

FOREIGN PATENT DOCUMENTS

JP H 10-250768 A 9/1998

* cited by examiner

*Primary Examiner* — Rafael A Ortiz
(74) *Attorney, Agent, or Firm* — Stein IP LLC

(57) ABSTRACT

A cushioning member for protecting a packed object, the cushioning member being designed to have an excellent cushioning effect with a small form and advantageously reduce industrial waste. The cushioning member includes a first cushioning member made of a foam material with a front face disposed adjacent to a packed object and a back side extending with a first width in the longitudinal direction on the opposite side from the front face, and a second cushioning member including a corrugated board assembly. The first cushioning member is fixed on the second cushioning member in a state in which the back side is in contact with the upper ends of the bridge portions.

6 Claims, 8 Drawing Sheets

CUSHIONING MEMBER FOR PACKED OBJECT

CROSS-REFERENCE TO RELATED APPLICATIONS

This application claims the benefit of Japanese Patent Application No. 2024-046778 filed on Mar. 22, 2024, in the Japanese Patent Office. All disclosures of the document named above are incorporated herein by reference.

TECHNICAL FIELD

The present invention relates to a cushioning member for protecting a packed object.

BACKGROUND ART

When industrial products or the like are transported to a remote destination (e.g., overseas) by using a shipping container or the like, a packing structure is adopted in which the products are secured in a packing frame to be protected from vibration and shocks during transportation.

For example, Patent Literature 1 discloses a packing structure in which an outboard motor placed horizontally is sandwiched between polystyrene foam pads from above and below and is secured on a wooden skid with square posts and angled paper tubes. This packing structure is aimed at lightweight and compact outboard motors, but is not usable for medium-sized or large-sized outboard motors. Furthermore, the packing structure is not strong enough to withstand multi-level stacking despite the flat packing shape, resulting in poor loading efficiency. In addition, the packing structure is based on a configuration that receives a load with a wide pad to distribute the load. This may lead to greater use of polystyrene foam, which will become industrial waste.

In the case of outboard motors, particularly medium-sized or larger outboard motors, a packing form is adopted in which an outboard motor in an upright position with its propulsion direction facing downwards is bolted and stored on a stand erected on the inner bottom of the packing frame, by using a stern bracket as a structure for securing the outboard motor to a hull.

In this packing form, no support structure is practically provided for the packing frame other than the stern bracket, and the outboard motor is supported inside the packing frame in an overhanging state on both sides of the stand. Moreover, the center of gravity is placed high relative to the support position and is biased toward the engine. Therefore, when an impact is applied due to an external factor during loading and unloading operations or transportation, the outboard motor, which is a packed object, may swing and come into contact with the packing frame. Thus, in order to avoid damage caused by contact, a cushioning material such as polystyrene foam is also used.

In addition, final products such as outboard motors are transported to a delivery destination in a packed state. Thus, the packing frame is basically a one-way packing material. In order to reduce additional cost, the packing frame is designed to have minimum strength and rigidity required for ordinary loading and unloading operations and transportation. For this reason, when a large impact occurs due to an external factor, in particular, the packing frame topples over, the cushioning material including polystyrene foam may fail to absorb the impact and may break, leading to damage to the outboard motor that is the packed object.

CITATION LIST

Patent Literature

[Patent Literature 1] JP H10-250768 A

SUMMARY OF INVENTION

Problem to be Solved by the Invention

The present invention has been devised in view of such circumstances. An object of the present invention is to provide a cushioning member for protecting a packed object, the cushioning member being designed to have an excellent cushioning effect with a small form and advantageously reduce industrial waste.

Means for Solving the Problem

In order to solve the problem, the present invention is a cushioning member disposed inside a side of a packing frame surrounding a packed object, the cushioning member being provided to protect the packed object secured on an inner bottom of the packing frame, the cushioning member comprising:

a first cushioning member made of a foam material having a front face disposed adjacent to the packed object, a back side extending with a first width in the longitudinal direction on the opposite side from the front face, a side extending between the side edge of the back side and the front face, and an end face extending between the end edge of the back side in the longitudinal direction and the front face; and a second cushioning member including a corrugated board assembly, the second cushioning member having a bottom wall extending in the longitudinal direction, a pair of side walls connected on both sides of the bottom wall via folding portions, and a plurality of bridge portions that extend between the pair of side walls so as to bridge the pair of side walls and extend in a direction perpendicular to the bottom wall, the second cushioning member being configured such that the bottom wall and the side walls form a channel extending in the longitudinal direction with a second width the same or larger than the first width, wherein the first cushioning member is fixed on the second cushioning member in a state in which the back side is in contact with the upper ends of the bridge portions in the range of the channel.

Advantageous Effect of Invention

According to the cushioning member of the present invention configured thus, when a large impact is applied by an external factor, an impact load applied from the packed object to the cushioning member is reduced by elastic deformation of the first cushioning member made of a foam material and is absorbed by plastic deformation of the second cushioning member including a corrugated board assembly, and breakage of the first cushioning member, in particular, breakage in an initial stage is reduced, thereby obtaining an excellent cushioning effect. Furthermore, as compared with a case in which a cushioning member is entirely made of a foam material, the present invention can reduce the amount of foam material used, which generates industrial waste after use.

MODE FOR CARRYING OUT THE INVENTION

Embodiments according to the present invention will be specifically described below with reference to the accompanying drawings.

Figure 1:
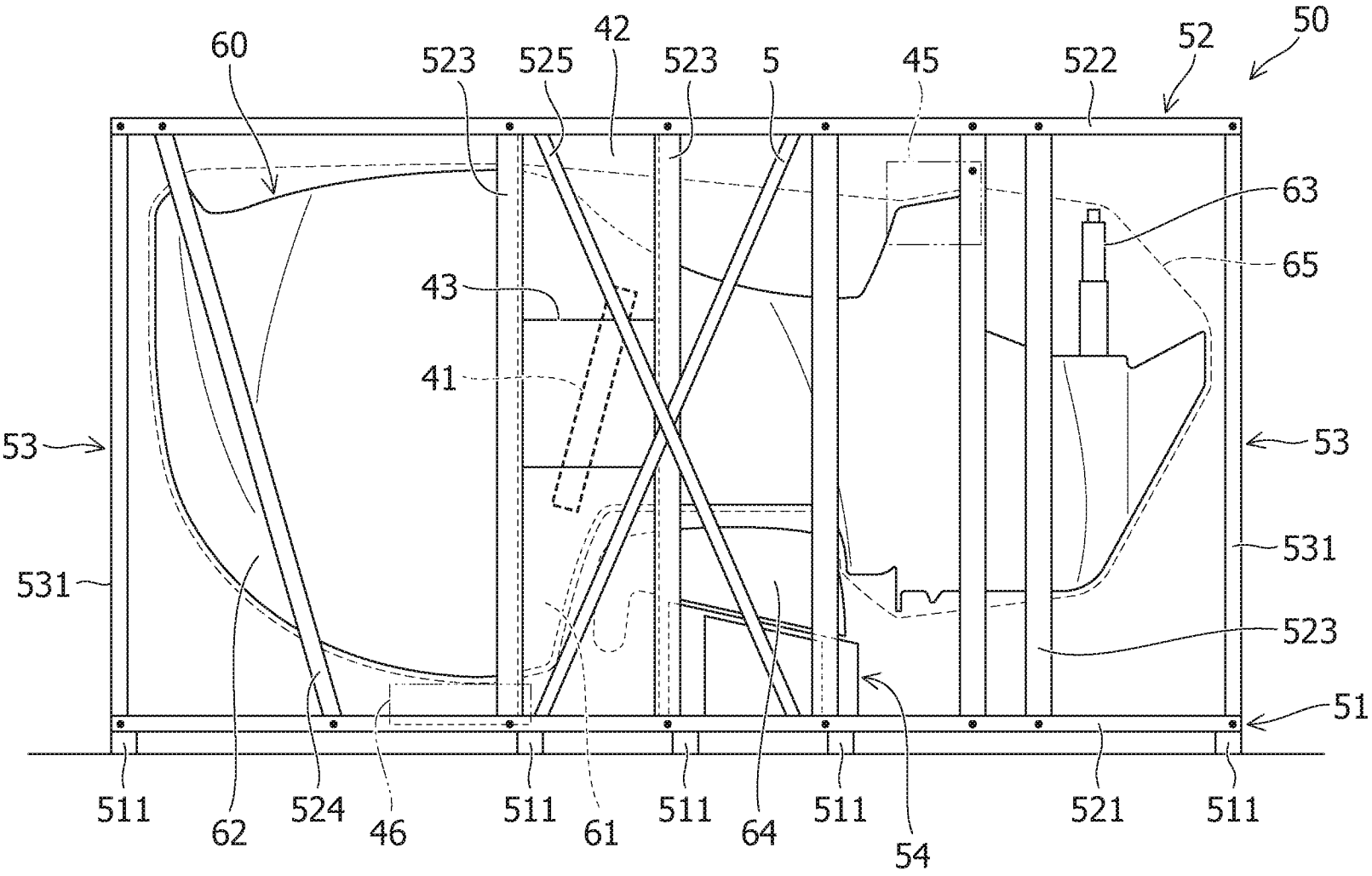
FIG. 1 is a front view illustrating a packing structure for an outboard motor.
Figure 2:
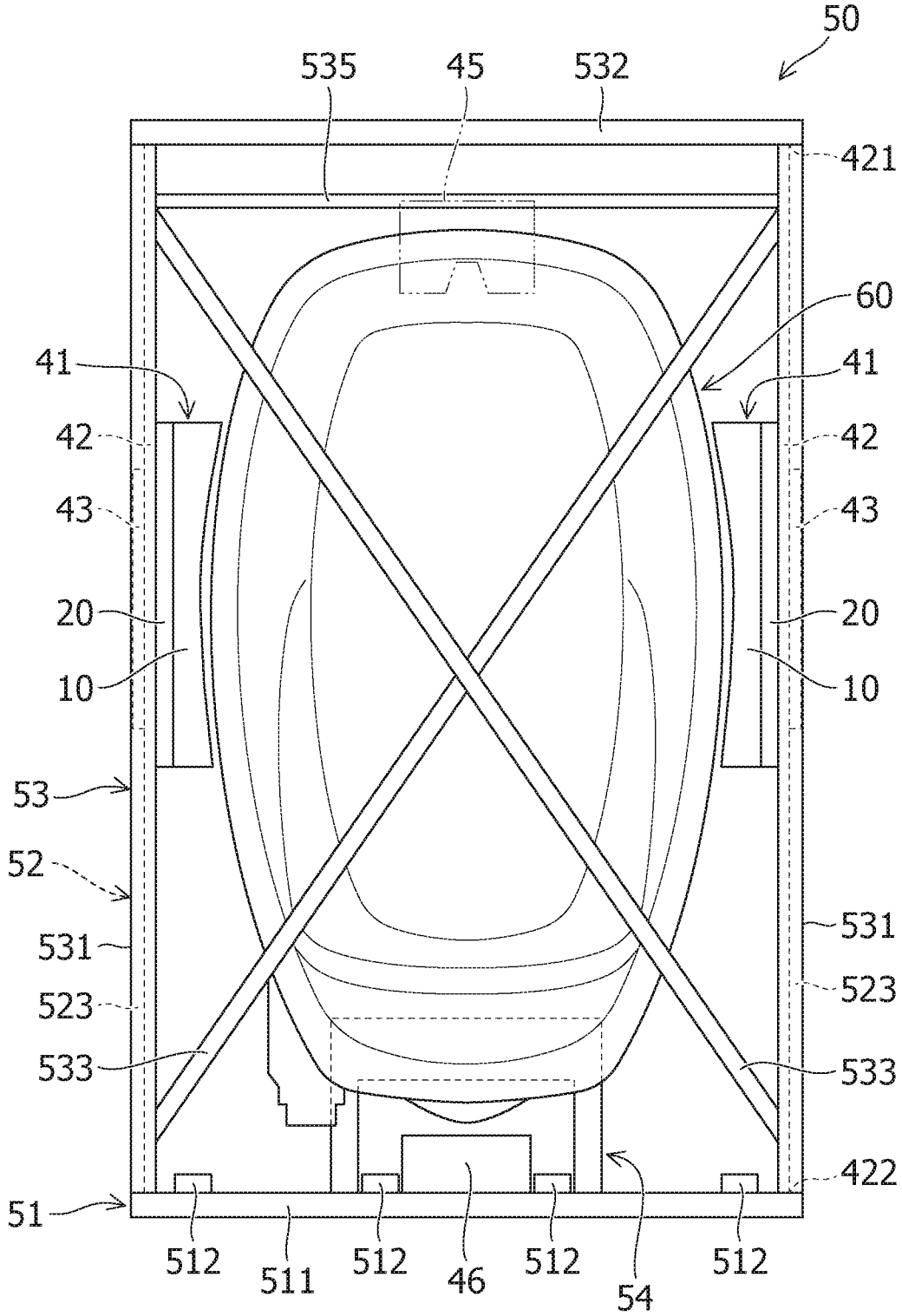
FIG. 2 is a side view illustrating the packing structure for the outboard motor.

FIGS. 1 and 2 illustrate a packing structure in which an outboard motor 60 serving as a packed object is secured and stored in a packing frame 50. The packing frame 50 includes a bottom frame 51 constituting a skid and side frames 52 and end frames 53 that constitute a crate part around the bottom frame 51. A stand 54 is erected nearly at the center of the bottom frame 51.

The outboard motor 60 is secured on a stand 54 in an upright position with its propulsion direction facing downwards by bolting a stern bracket 64 placed on the stand 54. A propeller (not illustrated) has been removed from a propeller shaft 63 and is packed with a sheet 65 (e.g., a plastic film) in this state.

Subsequently, the lower part (521) of the side frame 52 is fixed to each of the long sides of the bottom frame 51 with bolts, the lower end of the end frame 53 is fixed to each of the short sides of the bottom frame 51 with bolts, the side frame 52 and the end frame 53 are joined to each other with bolts, and the upper parts of the opposed side frames 52 are connected via a reinforcing frame (not illustrated), which constitutes the crate part surrounding the outboard motor 60. Thereafter, the packing frame 50 is covered with a corrugated box (not illustrated) from above and is shipped in this state.

The bottom frame 51 is configured as a skid such that five base frames 511 arranged in parallel in the widthwise direction and four longitudinal frames 512 arranged in parallel in the lengthwise direction so as to intersect over the base frames 511 are joined with a base plate, which is not illustrated. The base frames 511 and the longitudinal frames 512 are composed of structural materials such as channel materials. The stand 54 includes leg parts erected adjacent to the joint between the two base frames 511 and the two longitudinal frames 512 near the center, and a top surface part that fits to the stern bracket 64 and has the same inclination as the transom board of a ship such that the crankshaft of the engine is placed in a horizontal position while the outboard motor 60 is secured.

As illustrated in FIG. 1, the side frame 52 is configured such that a lower frame 521 serving as a fixed part on the bottom frame 51 and an upper frame 522 are bolted to the lower and upper end parts of multiple vertical frames 523, respectively, are welded to the ends of a pair of braces 525 welded together at their central intersection, and are rigidly joined without deformation by fastening a brace 524. The lower frame 521, the upper frame 522, and the brace 524 are composed of L-angle structural materials, and the vertical frames 523 are composed of hat-shaped structural materials.

As illustrated in FIG. 2, the end frame 53 is configured such that the upper parts of a pair of vertical frames 531 are joined via an upper frame 532 and are rigidly joined without deformation by welding a pair of braces 533 welded together at their central intersection. The vertical frames 531 and the upper frame 532 are composed of L-angle structural materials. A reinforcing frame 535 is installed between the side frames 52 and serves as a support structure of an upper cushioning member 45.

As described above, the side frames 52 and the end frames 53 surrounding around the outboard motor 60 fixed to the stand 54 on the bottom frame 51 each have a trussed structure that protects the outboard motor 60 and is strong and rigid enough to be stacked when loaded and stored into a container.

However, medium-sized and large-sized outboard motors are 1.5 to 2 m in overall height and 100 to 350 kg in weight and are supported with a large overhang on the stand 54. In addition, the center of gravity is high relative to the supporting position and is biased toward the engine on the left side of FIG. 1. Moreover, as described above, the packing frame 50 is basically a one-way shipping packing material and is designed to have minimum strength and rigidity required for ordinary loading and unloading operations and transportation.

Thus, when an excessive impact is applied to the packing frame 50 by an external factor during loading and unloading operations and transportation, for example, when a carrier vehicle passes through bumps on a road, e.g., speed bumps without deceleration during land transportation, the outboard motor 60 may swing in the packing frame 50 and come into contact with the packing frame 50. In particular, when the packing frame 50 topples over, it is difficult for the stand 54 to cantilever the outboard motor 60, so that the outboard motor 60 may fall onto the inner surface of the packing frame 50.

Thus, in order to prevent the outboard motor 60 from being damaged when in contact with the packing frame 50, cushioning members 41, 45, and 46 that are adjacent to the outboard motor 60 are provided inside the packing frame 50.

Among the cushioning members, the cushioning member 45 is provided for an upward movement around a cavitation plate when a moment occurs counterclockwise in FIG. 1 due to the biased center of gravity of the outboard motor 60 described above. The cushioning member 46 is provided for a downward movement of a top cowl 62. The cushioning member 46 is fixed on the base plate of the bottom frame 51.

In contrast, the cushioning members 41 are disposed adjacent to the sides of the outboard motor 60 inside the side frames 52 in order to reduce lateral swings of the outboard motor 60 in FIG. 2 and an impact when the outboard motor 60 falls due to the toppling over of the packing frame 50. The cushioning members 41 and the mounting structure will be described below with reference to the accompanying drawings.

Mounting Structure of Cushioning Member 41

Figure 3A:
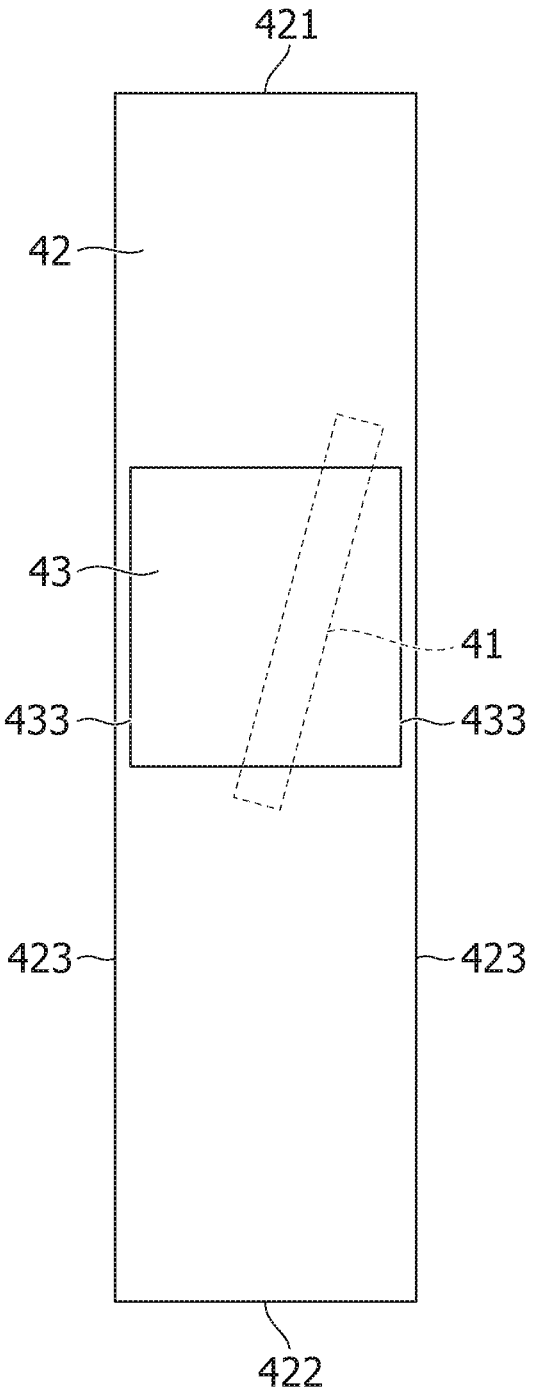
FIG. 3A is a front view illustrating the mounting structure of a cushioning member.
Figure 3B:
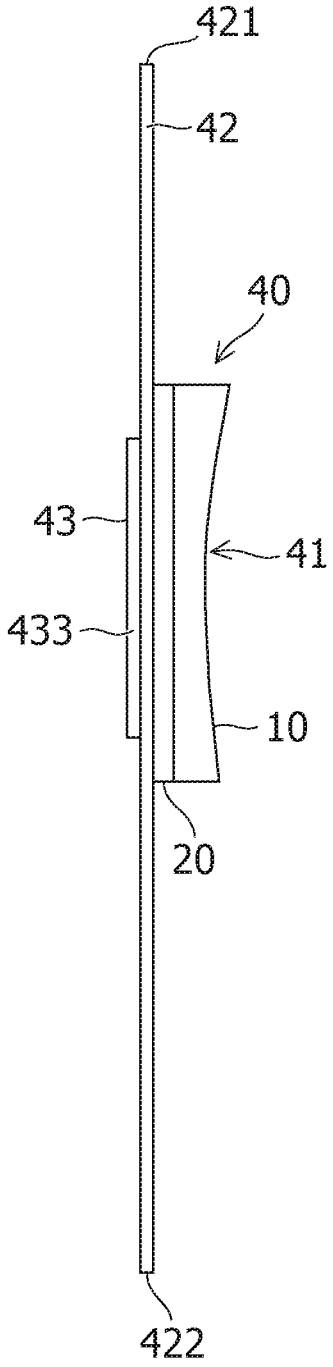
FIG. 3B is a side view illustrating the mounting structure of the cushioning member.

As illustrated in FIGS. 2, 3A, and 3B, the cushioning member 41 includes a first cushioning member 10 having a surface including a curved surface that is formed two-dimensionally or three-dimensionally to conform to the shape of the side of the outboard motor 60 near a bottom cowl 61, and a second cushioning member 20 that supports the first cushioning member 10 while being placed in contact with the back side of the first cushioning member 10. The first cushioning member 10 is made of a foam material, and the second cushioning member 20 comprises a corrugated board assembly.

As illustrated in FIG. 1, the cushioning member 41 is joined to the surface of a base part 42 at the bottom of the second cushioning member 20 while being oriented along the shape of the bottom cowl 61 of the outboard motor 60. The base part 42 includes a corrugated cardboard sheet, and an anchor part 43 like a block is joined to the back side of the base part 42. The anchor part 43 includes a laminate of corrugated cardboard sheets, and thus. the base part 42 and the anchor part 43 also have the cushioning function in the thickness direction and constitute a cushioning member assembly 40 with the cushioning member 41.

The cushioning member 41 (cushioning member assembly 40) having such a mounting structure is disposed adjacent to the side of the outboard motor 60 inside the side frame 52 by fitting the anchor part 43 between the two vertical frames 523 such that side edge portions 423 of the base part 42 overlap the inner sides of parts (flange portions) of the two adjacent vertical frames 523 of the side frame 52, and the side edge 433 of the anchor portion 43 is caught between the two vertical frames 523.

The base part 42 has a length corresponding to the length from the upper end to the lower end of the vertical frame 523 in the vertical direction. A lower end 422 of the base part 42 is supported at the inner bottom of the packing frame 50, and an upper end 421 of the base part 42 is in contact with or adjacent to the upper frame 522 in this state. This configuration prevents a displacement of the cushioning members 41 during transportation.

Assembly Structure of Cushioning Member 41

An embodiment of the first cushioning member 10 and the second cushioning member 20 that constitute the cushioning member 41 will be described below with reference to the accompanying drawings.

Figure 4:
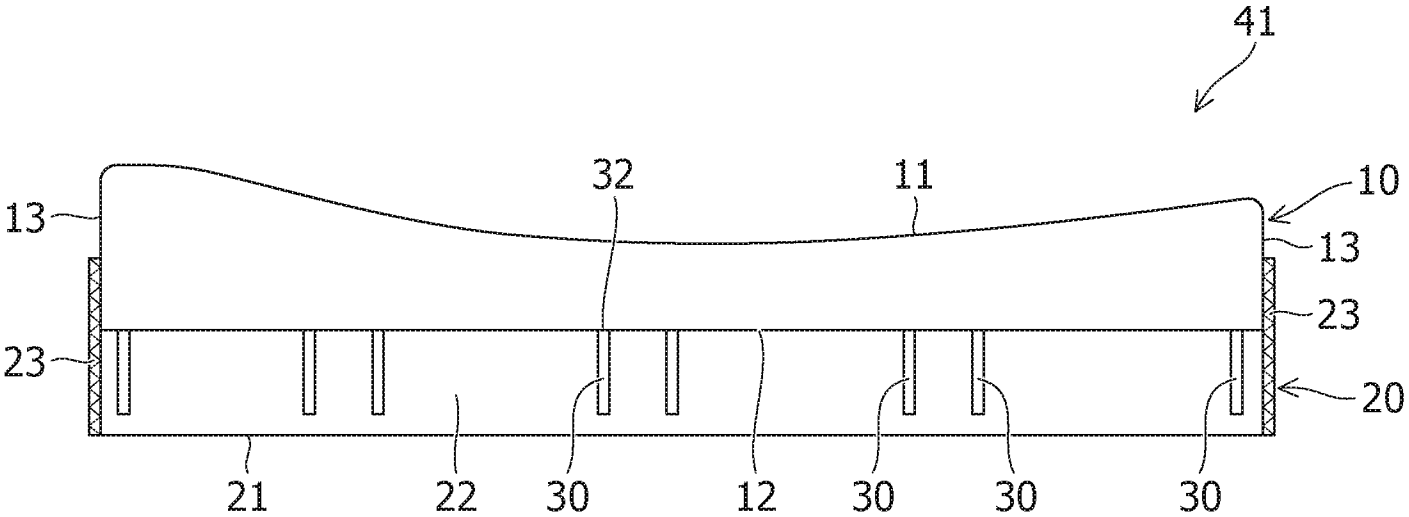
FIG. 4 is a side view illustrating the cushioning member.

As illustrated in FIG. 4, the first cushioning member 10 has a front face 11 including a curved surface conforming to the shape of the side of the outboard motor 60 and a back side 12 having a flat basic shape, and is configured like a long and narrow block extending with a first width w1 in the longitudinal direction. Although a foamed material constituting the first cushioning member 10 is not particularly limited, a foamed material of synthetic resin, e.g., polystyrene foam, may be properly used.

Figure 6A:
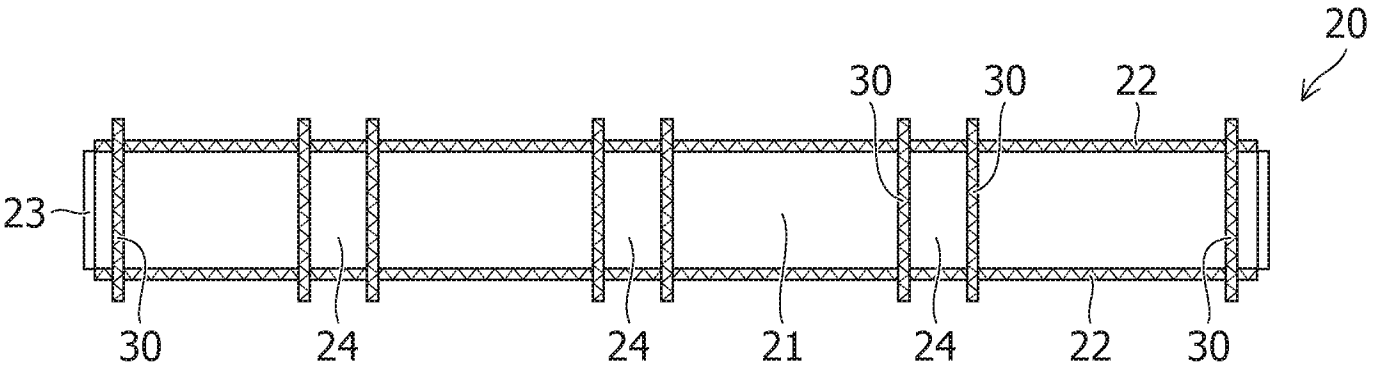
FIG. 6A is a plan view illustrating a second cushioning member.
Figure 6B:
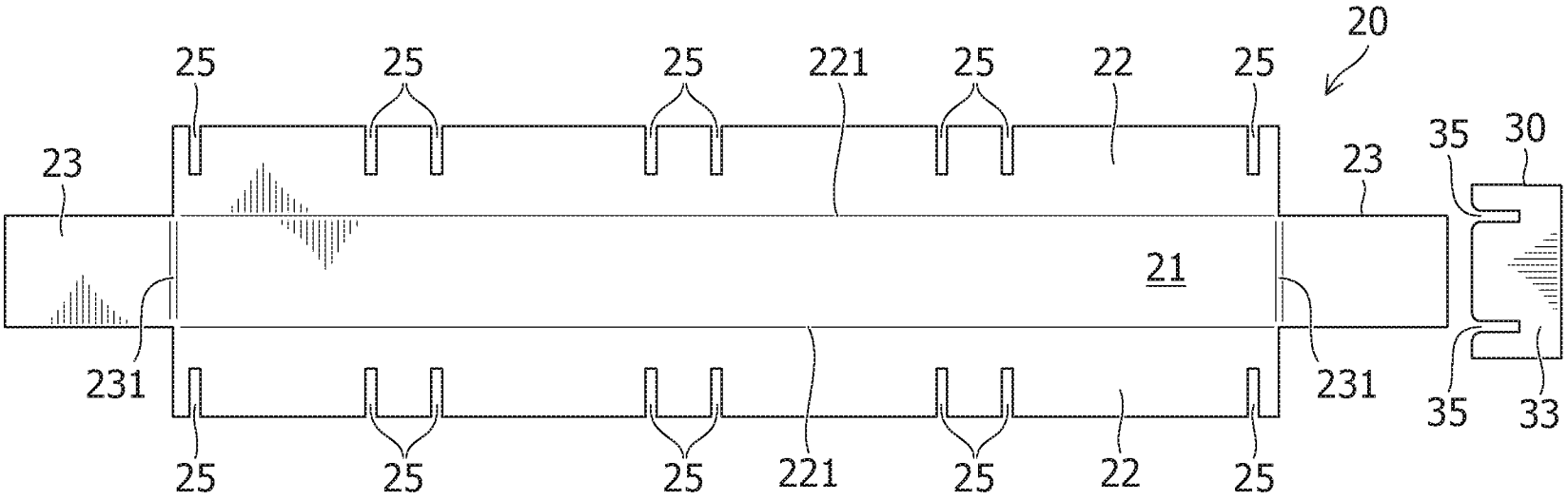
FIG. 6B is a development view illustrating the second cushioning member.

As illustrated in FIG. 6B, the second cushioning member 20 is formed by a corrugated cardboard blank having a bottom wall 21, a pair of side walls 22, and a pair of end flaps 23 such that the width direction orthogonal to the longitudinal direction serves as a flute direction. In other words, folding lines 221 and 231 (creases, scores) are processed on both sides and both ends of the bottom wall 21, and the bottom wall 21 connects to the side walls 22 and the end flaps 23 via the folding lines. On the edges of the side walls 22, slits 25 to be engaged with engagement tabs 33 of bridge portions 30 are provided.

Figure 7:
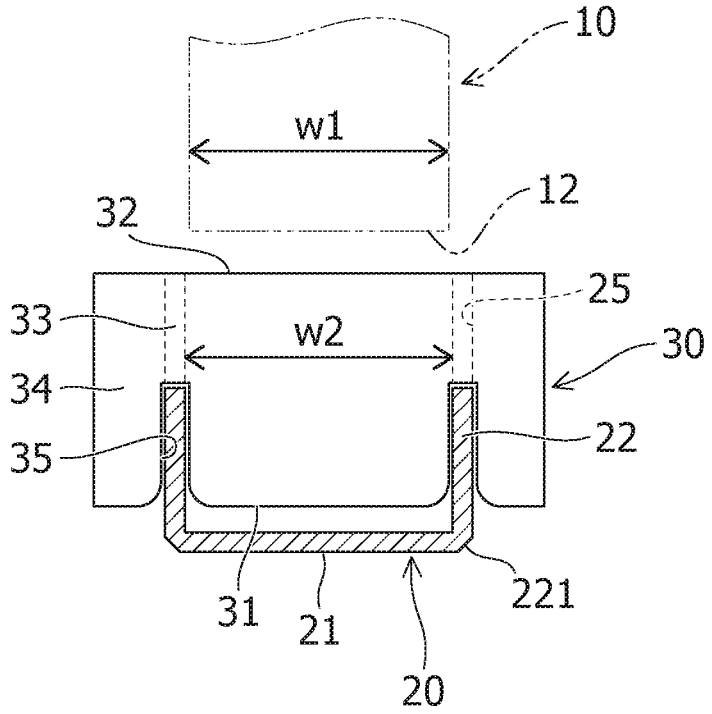
FIG. 7 is a cross-sectional view illustrating the principal part of the cushioning member in a disassembled state.

The plurality of bridge portions 30 are formed by corrugated cardboard blanks identical in shape such that a direction from an upper end 32 to a lower end 31 serves as the flute direction. At positions corresponding to the engagement tabs 33 on both sides of the lower end 31, engagement slots 35 are provided. The engagement slots 35 are engaged with portions under the slits 25 of the side walls 22 toward the engagement tabs 33 near the upper end 32. As illustrated in FIG. 7, extended portions 34 are formed so as to extend laterally through the engagement tabs 33. Furthermore, at an introducing portion on the lower end of the engagement slot 35, an extended opening portion is formed to facilitate engagement with the slit 25.

Thereafter, the folding line 221 on both sides of the bottom walls 21 are folded, the bottom wall 21 and the pair of side walls 22 on both sides form a channel shape extending in the longitudinal direction with a second width w2, and the engagement slots 35 of the bridge portions 30 are engaged into the respective slits 25 to engage the engagement tabs 33, so that, as illustrated in FIG. 6A, the side walls 22 are bridged by the bridge portions 30 and the adjacent three pairs of the bridge portions 30 and the side walls 22 form three box-shaped portions 24.

Figure 5:
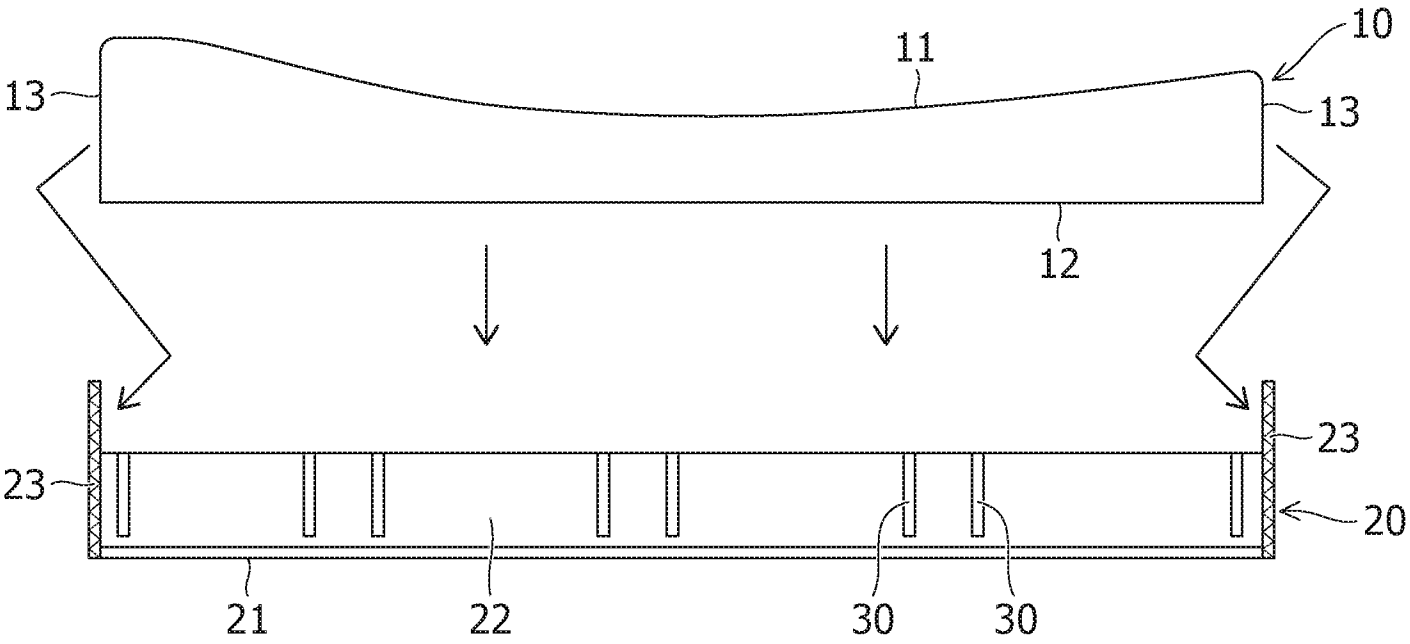
FIG. 5 is a side view illustrating a disassembled state of the cushioning member.

As illustrated in FIGS. 5 and 7, the engagement tabs 33 of the bridge portion 30 are engaged into the slits 25 of the side walls 22. In this state, a clearance is formed between the lower end 31 of the bridge portion 30 and the bottom wall 21. In other words, the dimensions of the height from the upper end 32 to the lower end 31 of the bridge portion 30 and the depth of the engagement slot 35 (the length of the engagement tab 33 in the engaging direction) are determined so as to form a clearance between the bridge portion 30 and the bottom wall 21 in an engaged state.

Figure 9A:
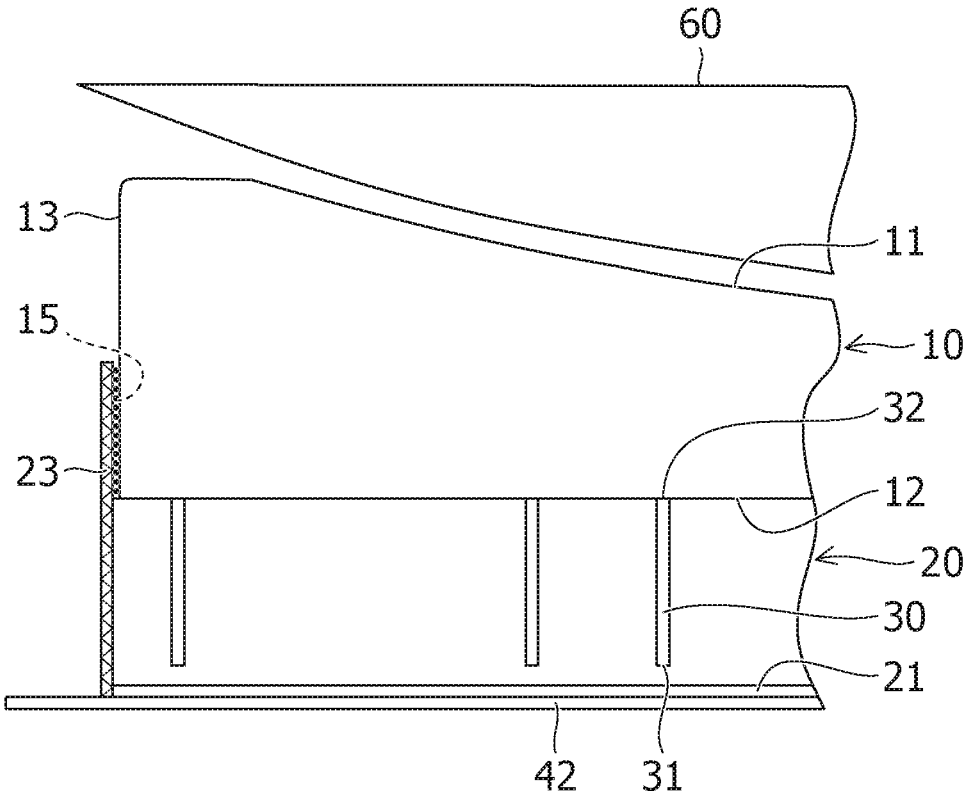
FIG. 9A is a side view illustrating the principal part of the cushioning member.
Figure 9B:
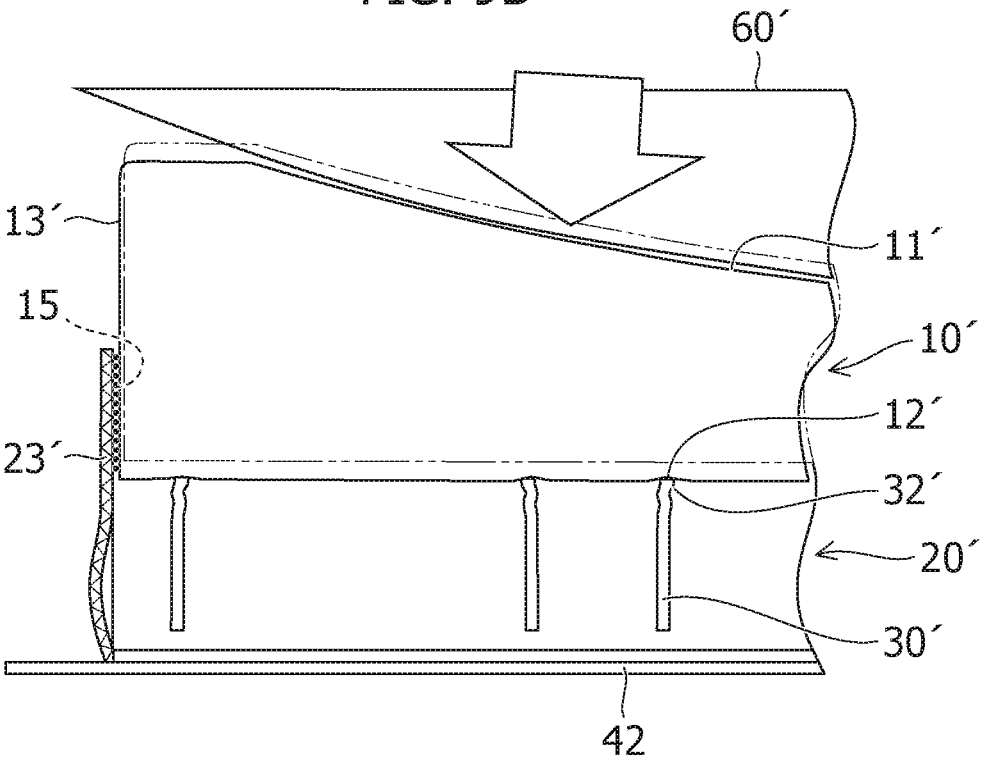
FIG. 9B is a side view illustrating the principal part of the cushioning member in a deformed state.

As illustrated in FIG. 5, the first cushioning member 10 is placed on the second cushioning member 20 such that the back side 12 of the first cushioning member 10 comes into contact with the upper ends of the bridge portions 30 of the second cushioning member 20. In this state, the end flaps 23 of the second cushioning member 20 are joined to the end faces 13 of the first cushioning member 10, so that the first cushioning member 10 and the second cushioning member 20 are integrated. As illustrated in FIGS. 9A and 9B, the end flap 23 is oriented with the flute direction in the width direction and thus can be deformed in the height direction at a non-joint portion while maintaining a joint 15 with the end face 13. The end flap 23 does not interfere with deformation of the first cushioning member 10 and plastic deformation of the second cushioning member 20 (bridge portions 30).

(Impact Absorbing Effect of Cushioning Member 41)

Figure 8:
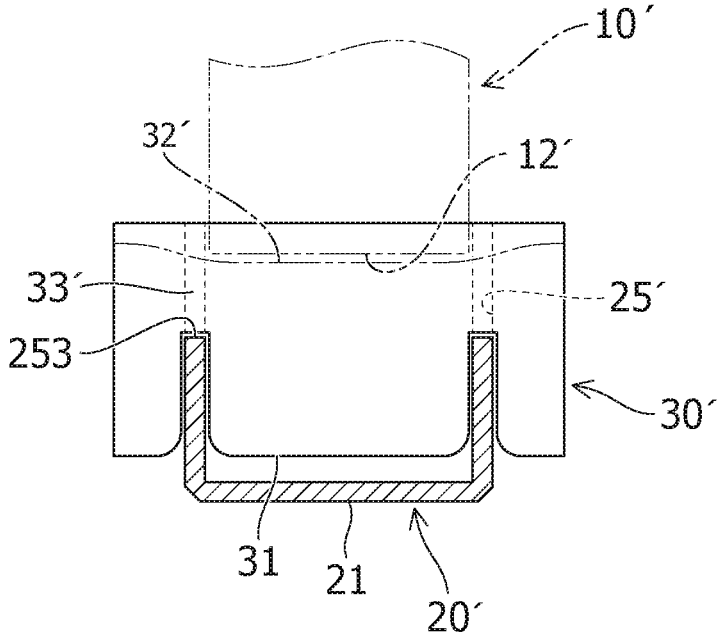
FIG. 8 is a cross-sectional view illustrating the principal part of the cushioning member in a deformed state.

As described above, the cushioning member 41 (cushioning member assembly 40) including the first cushioning member 10' made of a foam material and the second cushioning member 20 including a corrugated board assembly is disposed adjacent to one side of the outboard motor 60 inside the side frame 52 of the packing frame 50. With this configuration, when the packing frame 50 falls sideways and the outboard motor 60 falls laterally in the packing frame 50 due to an external factor during transportation of the outboard motor 60 (packing frame 50) or loading and unloading operations, as illustrated in FIGS. 8 and 9B, the first cushioning member 10' and the second cushioning member 20 are located under an outboard motor 60', so that an impact load from the outboard motor 60' is applied to a front face 11' of a first cushioning member 10', the first cushioning member 10' is pressed downward while being partially subjected to elastic deformation and is inserted between side walls 22 of a second cushioning member 20', and bridge portions 30' start plastic deformation from upper ends 32' (first step).

Furthermore, the first cushioning member 10' moves downward between the side walls 22, the upper ends 32' and engagement tabs 33' of the bridge portions 30' of the second cushioning member 20' are further plastically deformed to bring the lower ends 31 into contact with the bottom wall 21, the overall bridge portions 30' is further plastically deformed, and slits 25' and slit bottoms 253 of the side walls 22 are further plastically deformed, so that the bridge portions 30' are broken before the first cushioning member 10' reaches the elastic limit (second step).

Thereafter, the first cushioning member 10' having the undersurface (back side 12) placed on the bottom wall 21 is elastically and partially plastically compressed by the load of the outboard motor 60'. The falling of the outboard motor 60' is ended while the static load of the outboard motor 60' is received (third step).

In reality, the foregoing process is terminated nearly in a moment. The elastic deformation of the first cushioning member 10 made of a foam material and the plastic deformation of the second cushioning member 20 including a corrugated board assembly have different deformation patterns, the elastic compression of the first cushioning member 10 is delayed by, in particular, the plastic deformation of the second cushioning member 20, and the plastic deformation of the second cushioning member 20 is decelerated. Such synergistic action can avoid breakage of the first cushioning member 10 and maximize an impact absorbing effect obtained by the elastic deformation of the first cushioning member 10 and the plastic deformation of the second cushioning member 20, thereby advantageously preventing damage to the outboard motor 60.

In the foregoing process, the first cushioning member 10 enters a channel shape defined between the side walls 22 of the second cushioning member 20, and the sides of the first cushioning member 10 are guided by the side walls 22. In addition, the end flap 23 of the second cushioning member 20 forms the joint 15 with the end face 13 of the first cushioning member 10. Thus, a displacement between the first cushioning member 10 and the second cushioning member 20 is prevented, the first cushioning member 10 is securely guided between the side walls 22 of the second cushioning member 20, and an impact load applied to the first cushioning member 10 is securely input to the bridge portions 30 of the second cushioning member 20, thereby obtaining an impact absorbing effect according to the design.

The embodiment of the present invention is described in the foregoing description. The present invention is not limited to the embodiment and can be modified and changed in various ways within the scope of the present invention.

For example, the foregoing embodiment described the configuration in which the end flap 23 of the second cushioning member 20 forms the joint 15 with the end face 13 of the first cushioning member 10, so that the first cushioning member 10 is held by the second cushioning member 20. The second cushioning member 20 may also be configured to hold the first cushioning member 10 with an engaging portion interconnecting the end face 13 of the first cushioning member 10 and the end flap 23 of the second cushioning member 20. For example, an opening formed on the end flap 23 of the second cushioning member 20 may be engaged with a protrusion on the end face 13 of the first cushioning member 10, or a narrow tongue-shaped piece formed on the end flap 23 of the second cushioning member 20 may be inserted and engaged into a slit vertically penetrating the extended portion of the end face 13 of the first cushioning member 10. With this configuration, the engaging portion can be configured without degrading the formability of the first cushioning member 10. Furthermore, the first cushioning member 10 may also be configured to be held by the second cushioning member 20 such that the back side 12 of the first cushioning member 10 is bonded to the upper ends 32 of the bridge portions 30 of the second cushioning member 20.

Moreover, the foregoing embodiment described the configuration in which the back side 12 of the first cushioning member 10 is formed flat. On the back side 12 of the first cushioning member 10, a protrusion may be provided between the pair of side walls 22 of the second cushioning member 20. Furthermore, grooves (recess portions) extending in the width direction in engagement with the upper ends 32 of the bridge portions 30 of the second cushioning member 20 may be formed on the back side 12 of the first cushioning member 10. These configurations provide an advantage in that a displacement between the first cushioning member 10 and the second cushioning member 20 can be more securely prevented.

In the foregoing embodiments, the upper ends 32 of the bridge portions 30 of the second cushioning member 20 are aligned with the upper ends of the side walls 22 in the side view. The upper ends of the side walls 22 may protrude upward from the upper ends 32 of the bridge portions 30. Such a protrusion does not contribute to reduction in manufacturing cost, but does provide an advantage in that the first cushioning member 10 is securely guided into the channel of the second cushioning member 20 to prevent a displacement between the first cushioning member 10 and the second cushioning member 20 as described above.

In the case of the foregoing embodiment, the bridge portions 30 of the second cushioning member 20 include three pairs of the bridge portions 30 that form the box-shaped portions 24 at three locations and the two bridge portions 30 adjacent to the end flaps 23. The bridge portions 30 may be arranged in a different layout with a different layout density.

In the foregoing embodiments, the cushioning member 41 is inclined along the bottom cowl 61, which is a high-strength part of the outboard motor 60, and is located midway between the vertical frames 523. The cushioning member 41 may be located inside the vertical frame 523 near the top cowl 62 on the left side of FIG. 1 or may be added. In this case, the cushioning member 41 may be directly fixed to the inside of the vertical frame 523 without the base part 42.

In the foregoing embodiments, the outboard motor 60 is a packed object. The cushioning members 41 according to the present invention can also be implemented when another packed object, e.g., a motorcycle, is transported with insufficient self-support like an outboard motor while being secured in an upright position in the packing frame.

REFERENCE SIGNS LIST

10 First cushioning member (foam material)
11 Front face
12 Back side
13 End face
20 Second cushioning member (corrugated board assembly)
21 Bottom wall
22 Side wall

23 End flap
25 Slit
30 Bridge portion
31 Lower end
32 Upper end
33 Engagement tab
35 Engagement slot
60 Outboard motor (packed object)
50 Packing frame
51 Bottom frame
52 Side frame
53 End frame
54 Stand

The invention claimed is:

1. A cushioning member disposed inside a side of a packing frame surrounding a packed object, the cushioning member being provided to protect the packed object secured on an inner bottom of the packing frame, the cushioning member comprising:

a first cushioning member made of a foam material having a front face disposed adjacent to the packed object, a back side extending in a longitudinal direction with a first width on an opposite side from the front face, a side extending between a side edge of the back side and the front face, and an end face extending between an end edge of the back side in the longitudinal direction and the front face; and a second cushioning member comprising a corrugated board assembly, the second cushioning member having a bottom wall extending in the longitudinal direction, a pair of side walls connected on both sides of the bottom wall via folding portions, and a plurality of bridge portions that extend between the pair of side walls so as to bridge the pair of side walls and extend in a direction perpendicular to the bottom wall, the second cushioning member being configured such that the bottom wall and the side walls form a channel extending in the longitudinal direction with a second width that is the same as or larger than the first width, wherein the first cushioning member is fixed on the second cushioning member in a state in which the back side is in contact with upper ends of the bridge portions in a range of the channel.

2. The cushioning member according to claim 1, wherein the second cushioning member includes a pair of end flaps connected on both sides of the bottom wall via folding portions, and the first cushioning member is fixed on the second cushioning member by joining or engaging the end flap onto the end face.

3. The cushioning member according to claim 2, wherein the bottom wall, the pair of side walls, and the pair of end flaps of the second cushioning member are formed by a first corrugated cardboard blank such that a flute direction of the first corrugated cardboard blank is orthogonal to the longitudinal direction, and the plurality of bridge portions are formed by a plurality of second corrugated cardboard blanks such that the perpendicular direction serves as a flute direction.

4. The cushioning member according to claim 3, wherein the bridge portion has a pair of engaging portions that are engaged with the pair of side walls to bridge the pair of side walls, and the engaging portion includes an engagement tab extending laterally to be engaged into a slit extending from an upper end of the side wall toward the bottom wall.

5. The cushioning member according to claim 4, wherein the engagement tab of the bridge portion further includes an extended portion that extends over the slit so as to form an engagement slot to be engaged with a portion under the slit of the side wall.

6. The cushioning member according to claim 1, wherein a length from the upper end to a lower end of the bridge portion is shorter than a length from the upper end to a lower end of the side wall, and a clearance is formed between the lower end of the bridge portion and the bottom wall.

* * * * *